United States Patent [19]

Braun

[11] 3,955,604

[45] May 11, 1976

[54] DEFLECTING DEVICE FOR FLAT TEXTILE STRUCTURES

[75] Inventor: Rudolf Braun, Winterthur, Switzerland

[73] Assignee: Sulzer Brothers Limited, Winterthur, Switzerland

[22] Filed: June 18, 1974

[21] Appl. No.: 480,574

[30] Foreign Application Priority Data

June 22, 1973 Switzerland ..... 9164/73

[52] U.S. Cl. ..... 139/308; 66/149 R; 226/171; 242/75.1

[51] Int. Cl.[2] ..... D03D 49/20; B65H 17/34

[58] Field of Search..... 139/304, 307, 308, 291 R, 139/99; 66/149–152; 242/75.1, 75; 226/170, 171

[56] References Cited

UNITED STATES PATENTS

| | | | |
|---|---|---|---|
| 2,052,493 | 8/1936 | Simmons | 139/307 |
| 2,070,147 | 2/1937 | Thompson | 139/304 |
| 2,219,797 | 10/1940 | Wattie | 139/307 |
| 2,670,907 | 3/1954 | Huck | 242/75.1 |
| 2,685,763 | 8/1954 | Courtney et al. | 226/170 X |
| 3,752,378 | 8/1973 | Scheffel | 139/99 UX |
| 3,760,609 | 9/1973 | Poocza et al. | 66/149 R |
| 3,831,830 | 8/1974 | Venot | 226/171 |

FOREIGN PATENTS OR APPLICATIONS

| | | | |
|---|---|---|---|
| 119,733 | 4/1927 | Switzerland | 226/170 |

*Primary Examiner*—James Kee Chi
*Attorney, Agent, or Firm*—Kenyon & Kenyon Reilly Carr & Chapin

[57] ABSTRACT

An endless belt is disposed between the cloth take-off roller of a weaving machine and the pressing roller in order to press a cloth passing between the belt and the take-off roller or between the belt and each of the take-off roller and pressing roller. The belt is disposed around a pair of tubes which are freely mounted within the belt.

8 Claims, 2 Drawing Figures

Fig.1

DEFLECTING DEVICE FOR FLAT TEXTILE STRUCTURES

Figure 1:
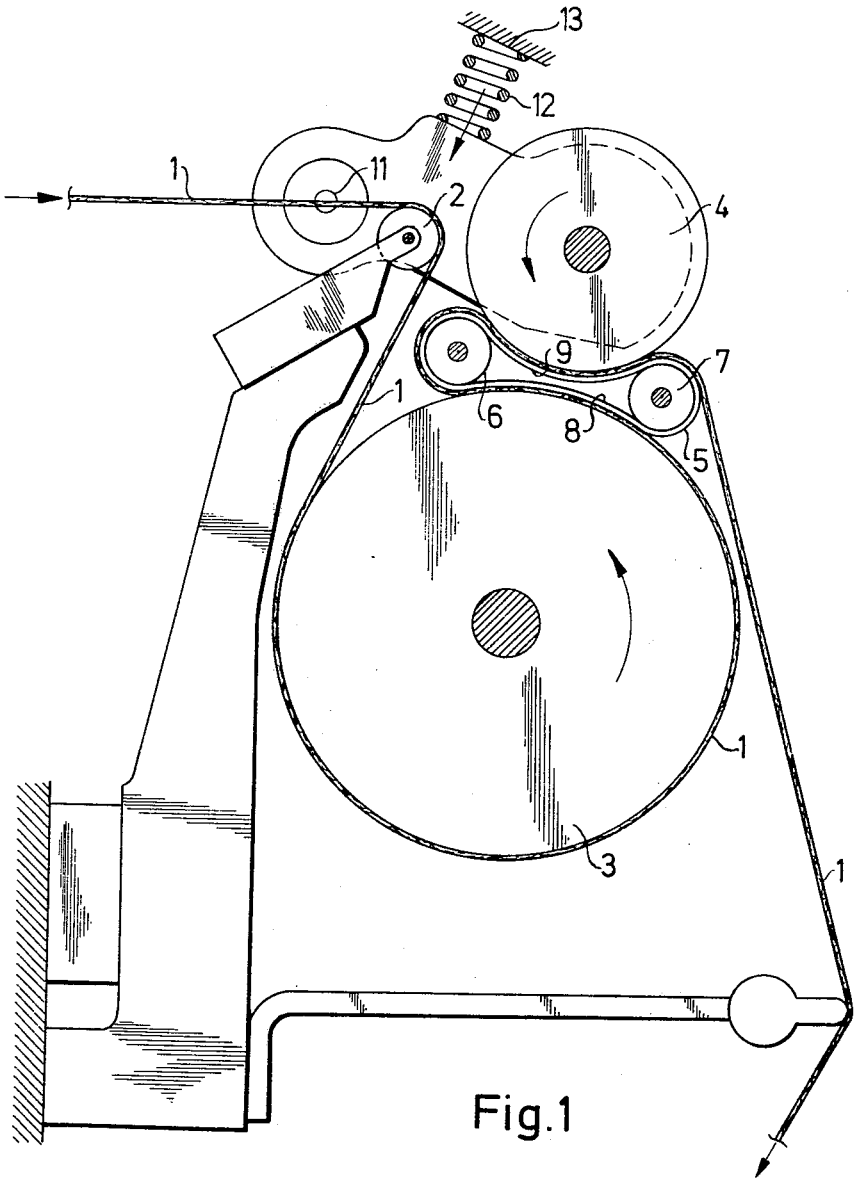

This invention relates to a deflecting device for flat textile structures such as woven fabrics.

Deflecting devices for flat textile structures have generally been formed of a deflecting roller and a pressing roller. In one conventional device of this kind, the pressing roller has been in linear contact with the deflecting roller. Also, the flat textile structure (a woven fabric or cloth will be assumed hereafter) has been drawn off the deflecting roller and immediately passed around the pressing roller for further processing, for example for winding up on a cloth beam of a weaving machine. Generally, the pressing roller has been acted upon by a force accumulator, for instance, two springs acting on bearings at each end of the pressing roller. However, because of the action of the springs at the ends of the pressing roller, the pressing roller is curved along the line where the pressing roller makes contact with the deflecting roller. This prevents true line contact. The cloth therefore slips through at the non-contacting zones and the deflecting roller, such as a cloth take-off roller of a weaving machine, may prematurely lose any rough surface covering, for example a corundum surface covering.

Accordingly, it is an object of the invention to provide a deflecting device which eliminates slipping of a cloth therethrough.

It is another object of the invention to provide a cloth deflecting device which is able to uniformly press a cloth passing therethrough.

It is another object of the invention to provide a deflecting device for flat textile structures which is not limited to line contact.

It is another object of the invention to use a cylindrical pressing roller in a deflecting device for flat textile structures.

Briefly, the invention provides a deflecting device for flat textile structures, such as a cloth, which comprises a deflecting roller, a pressing roller and an endless belt disposed between the deflecting roller and the pressing roller for passage of the flat textile structure between the endless belt and at least one of the deflecting roller and the processing roller in a pressed relation. The endless belt acts as a resilient intermediate element between the deflecting roller and the pressing roller. In addition, the pressing roller is pressed against the endless belt instead of engaging directly with the deflecting roller.

In use, the cloth moves between the deflecting roller and one run of the endless belt. Consequently, the cloth is pressed against a greater peripheral area of the deflecting roller than previously; the contact is, thus, not necessarily limited to a line contact. The cloth can also pass through between the pressing roller and the other belt run and can thereafter be subjected to further processing.

The presence of the resilient intermediate element in the form of the endless belt between the deflecting roller and pressing roller eliminates the problem of pressing roller curvature which occurs in a known device in which there is a line or linear contact. Further, instead of using a pressure roller of slightly convex or conical shape to compensate for this curvature and to achieve continuous pressing between the pressing roller and the deflecting roller, a cylindrical pressing roller can be used.

Figure 2:
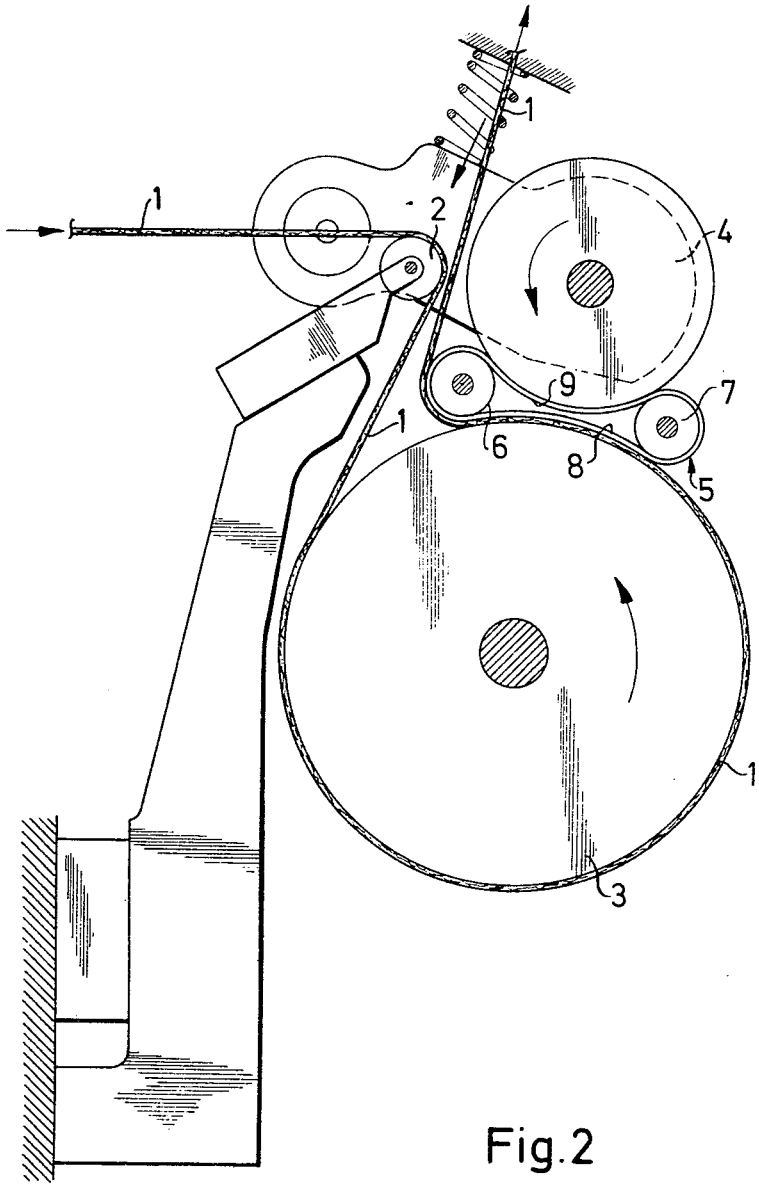

These and other objects and advantages of the invention will become more apparent from the following detailed description and appended claims taken in conjunction with the accompanying drawings in which:

FIG. 1 illustrates a simplified side view of a part of a weaving machine incorporating a deflecting device according to the invention; and FIG. 2 illustrates the structure of FIG. 1 used in a modified manner.

Referring to FIG. 1, a weaving machine (shown in part) for weaving flat textile structures, such as cloth 1, includes a breast beam 2 over which the cloth 1 passes after beating-up as is known. The weaving machine also has a deflecting device composed of a driven cloth take-off roller 3, a pressing roller 4 and an endless belt 5. The cloth take-off roller 3 rotates, as viewed, in a counterclockwise direction as indicated by the arrow and forms a deflecting roller. In addition, the pressing roller 4 is mounted in the machine in a known manner (not shown) above the take-off roller 3. Each of the rollers 3, 4 has an axis of rotation which is disposed in a common plane. The endless belt 5 is disposed between the rollers 3, 4 and is guided around a pair of rod-like elements, such as tubes 6, 7. The belt 5 has one run 8 disposed in facing relation to the take-off roller 3 to form a nip for passage of the cloth 1 therebetween and an opposite second run 9 disposed in facing relation to the pressing roller 4.

The tubes 6, 7 are disposed in freely mounted relation within the belt 5 at opposite ends of the runs 8, 9 for reversing the runs 8, 9. To this end, the tubes 6, 7 are devoid of bearings at both ends and are retained merely by the belt 5 and the pressure applied by the pressing roller 4. If required, the tubes 6, 7 can be secured by abutments or bearings against axial displacement, that is, displacement perpendicularly to the plane of the drawing. As shown, the tubes 6, 7 are each disposed on an opposite side of the plane in which the axes of rotation of the rollers 3, 4 are disposed. This plane also passes through each run 8, 9 of the belt 5.

The pressing roller 4 is rotatably mounted in a suitable frame which is pivotal about a pivot 11 and is biased by a pair of springs 12 (only one of which is shown) each of which abuts against a stationary machine part 13. As shown, the springs 12 bias the pressing roller 4 to pivot clockwise about the pivot 11 and to press against the run 9 of the belt 5. The opposite run 8 is thus biased against the take-off roller 3 to press the cloth 1.

As shown, during operation, the cloth 1 passes over the take-off roller 3 through an arcuate path and moves through the nip between the belt run 8 and the roller 3. During this time, the pressing roller 4 presses downwardly on the belt 5 against the run 9 so as to press the run 8 against the cloth 1 over a peripheral portion of the roller 3. The cloth 1 then passes between the nip between the belt run 9 and the pressing roller 4 and is further pressed over a peripheral portion of the roller 4 before descending to a driven cloth beam (not shown). A known guide, as shown, is provided to guide the cloth 1 below the deflecting device.

As greater or less force is imposed on the pressing roller 4 by the springs 12, the space between the belt runs 8, 9 is narrowed or widened. At the same time, the tubes 6, 7 are allowed to move relative to each other in a floating manner under the pressing force of the pressing roller 4. These tubes 6, 7 also rotate in a counter direction to the rotation of the deflecting roller 3, as shown, under the pressing force of the pressing roller 4.

Referring to FIG. 2, wherein like reference characters indicate like parts as above, the cloth 1 may also pass only between the belt run 8 and the take-off roller 3. In this case, the pressed cloth passes upwardly upon leaving the nip between the belt 5 and take-off roller 3 for further processing.

What is claimed is:

1. A deflecting device for flat textile structures comprising a deflecting roller for moving a flat textile structure through an arcuate path;

a pressure roller;

an endless belt disposed between said deflecting roller and said pressure roller for passage of the flat textile structure between said endless belt and at least said deflecting roller in a pressed relation, said endless belt having a first run disposed in facing relation to said deflecting roller for passage of the textile structure therebetween and a second run disposed in facing relation to said pressing roller, said second run being disposed under a pressing force from said pressing roller to press said first run towards said deflecting roller; and a pair of rod-like reversing elements freely mounted within said endless belt, each element being disposed on an opposite side of a plane passing through the axes of rotation of said deflecting roller and said pressing roller.

2. A deflecting device for flat textile structures comprising a deflecting roller for moving a flat textile structure through an arcuate path, an endless belt having a first run disposed in facing relation to said deflecting roller for passage of the textile structure therebetween, a pair of rod-like reversing elements within said endless belt, and a pressing roller pressing against said endless belt to press said first run against said deflecting roller and to press against said rod-like reversing elements within said endless belt.

3. A deflecting device as set forth in claim 2 wherein said reversing elements are freely mounted within said belt to rotate counter to the direction of rotation of said deflecting roller under the pressing force of said pressing roller.

4. In a weaving machine for flat textile cloth; a cloth take-off roller for taking-up a woven cloth, an endless belt having a first run disposed in facing relation to said take-off roller for passage of the cloth therebetween and a second run opposite said first run, and a pressing roller disposed in facing relation to said second run for pressing said second run towards said first run to bias said first run against said take-off roller to press the cloth therebetween.

5. In a weaving machine as set forth in claim 4, a pair of tubes disposed within said endless belt at opposite ends of said runs for reversing said runs.

6. In a weaving machine as set forth in claim 5 wherein said take-off roller and said pressing roller each have an axis of rotation in a common plane and said tubes are each disposed on an opposite side of said plane and wherein said plane passes through each said run of said belt.

7. In a weaving machine as set forth in claim 5 wherein said tubes are freely mounted within said belt.

8. In combination, a weaving machine for producing a flat textile structure; and a deflecting device including a cloth take-off roller of said weaving machine for moving the flat textile structure through an arcuate path, a pressing roller mounted on said weaving machine, and an endless belt disposed between said deflecting roller and said pressing roller, said belt having a first run disposed in facing relation to said deflecting roller for passage of the textile structure therebetween and a second run disposed in facing relation to said pressing roller, said second run being disposed under a pressing force from said pressing roller to press said first run towards said deflecting roller to press the textile structure therebetween.

* * * * *